United States Patent [19]

Mori et al.

[11] Patent Number: 5,032,493

[45] Date of Patent: Jul. 16, 1991

[54] METHOD OF DRYING PHOTOGRAPHIC LIGHT-SENSITIVE MATERIALS IN AUTOMATIC PROCESSOR

[75] Inventors: Hiroyuki Mori; Kunio Ishigaki, both of Kanagawa, Japan

[73] Assignee: Fuji Photo Film Co., Ltd., Kanagawa, Japan

[21] Appl. No.: 582,568

[22] Filed: Sep. 14, 1990

[30] Foreign Application Priority Data

Sep. 14, 1989 [JP] Japan ..... 1-239271

[51] Int. Cl.[5] ..... G03C 1/16

[52] U.S. Cl. ..... 430/353; 430/350; 430/401; 430/432

[58] Field of Search ..... 430/350, 351, 352, 353, 430/401, 432

[56] References Cited

U.S. PATENT DOCUMENTS

| | | | |
|---|---|---|---|
| 4,040,838 | 8/1977 | Yamaguchi | 430/350 |
| 4,764,453 | 8/1988 | Koboshi et al. | 430/352 |
| 4,940,652 | 7/1990 | Nagasaki | 430/429 |

*Primary Examiner*—Hoa Van Le

*Attorney, Agent, or Firm*—Sughrue, Mion, Zinn, Macpeak & Seas

[57] ABSTRACT

A method of drying a photographic light-sensitive material after development-processing in an automatic processor comprising a dry-processing portion, wherein the method comprises drying steps (a) and (b):

(a) drying the photographic light-sensitive material to an extent that 65% of the moisture content of the photographic material just after squeezing is dried out; and subsequently, (b) drying the photographic light-sensitive material at a temperature which is set based on temperature and humidity conditions of an area where the automatic processor is installed.

4 Claims, 2 Drawing Sheets

METHOD OF DRYING PHOTOGRAPHIC LIGHT-SENSITIVE MATERIALS IN AUTOMATIC PROCESSOR

FIELD OF THE INVENTION

This invention relates to a method of drying photographic light-sensitive materials in an automatic processor in order to ensure excellent dimensional stability in photographic light-sensitive materials.

BACKGROUND OF THE INVENTION

In general, a silver halide photographic material has layers containing a hydrophilic colloid binder such as gelatin on at least one side of a support. Hydrophilic colloid layers, unfortunately, tend to stretch in proportion with changes in humidity and/or temperature. These dimensional changes to a photographic light-sensitive material, particularly those used in graphic arts, can be a serious defect.

For graphic arts photographic materials, a number of methods have been proposed in the hope of increasing dimensional stability. Examples of these methods are specifying a ratio of for the total thickness of hydrophilic colloid layers to the thickness of the base (as disclosed in U.S. Pat. No. 3,201,250, and so on); incorporating a polymer latex into a hydrophilic colloid layer (as disclosed in JP-B -39-4272 (The term "JP-B" as used herein means an "examined Japanese patent publication"), JP-B-39-17702, JP-B-43-13482, JP-B-45-5331, U.S. Pat. Nos. 2,376,005, 2,763,625, 2,772,166, 2,852,386, 2,853,457, 3,397,988, 3,411,911 and 3,411,912); and providing a waterproofing layer as an undercoat of the support surface (as disclosed in JP-A-60-3627 (The term "JP-A" as used herein means an "unexamined published Japanese patent application"). Even when the light-sensitive materials themselves are improved by using methods such as described above, it is essentially difficult to improve the dimensional stability of a hydrophilic colloid, like gelatin, under all possible variations of temperature/humidity. Various methods have been proposed for controlling the drying conditions during the dry-processing of automatic processor by using a heater (as disclosed in JP-A-56-095239, JP-A-63-049760, JP-A-63-236043). These methods were directed mainly toward the development of drying methods that would increase drying speed, save energy, and ensure excellent emulsion coats and high travelling facility.

More specifically, one of increasing drying speed involved using a flow of drying air that was slow and weak during the first half of the drying step, and then fast and strong during the latter half of the drying step. Another methods involves lowering the preheating temperature of the heater when light-sensitive materials were not in the apparatus to use energy more economically. Another art consisted of detecting the temperature and the humidity of the room in which the automatic processor was installed (hereinafter "the surrounding temperature and humidity") and controlling the drying in the automatic processor based on this information so that the light-sensitive materials would not be overdried or underdried.

However, these methods did not improve the dimensional stability of a light-sensitive material under all possible variations of temperature/humidity. For instance, during a time of low humidity, such as winter, the dimension of a light-sensitive material is lengthened because the temperature of the drying air in the processor is high which results in the light-sensitive material being "overdried". On the other hand, during a time of high humidity such as during the summer, the temperature of the drying air is set such that the light-sensitive material is barely dried, which causes a shrinkage of the light-sensitive material. Such variation are referred to as the "aggravation of dimensional stability through processing". Aggravation of dimensional stability is, particularly a problem for light-sensitive materials used for the graphic arts.

No attempts are known to have been made to heighten the dimensional stability of a light-sensitive material through the use of an automatic processor.

In addition, it has not yet been known that the dimensional stability can be improved by controlling the temperature of drying air.

SUMMARY OF THE INVENTION

An object of the present invention is to provide a method of drying a photographic light-sensitive material after development-processing in an automatic processor comprising a dry-processing portion in order to ensure excellent dimensional stability in photographic light-sensitive materials.

An another object of the present invention is to provide a method of controlling the dry-processing portion of an automatic processor to improve the dimensional stability of light-sensitive material under all possible temperature humidity conditions.

The above-described objects are attained with a method of drying a photographic light-sensitive material after development-processing in an automatic processor comprising a dry-processing portion, wherein the method comprises drying steps (a) and (b):

(a) drying the photographic light-sensitive material to an extent that 65% of the moisture content of the photographic material just after squeezing is dried out; and subsequently, (b) drying the photographic light-sensitive material at a temperature which is set based on temperature and humidity conditions of an area where the automatic processor is installed.

In the present invention, drying of a photographic light-sensitive material after having dried out 65% of the moisture content of the photographic light-sensitive material is carried out at least under the control based on temperature and humidity conditions of an area where an automatic processor is installed.

In more preferred embodiment for achieving the object of this invention, the temperature of the drying step (b) falls within the zone which satisfies the following equations:

$$\text{when } 0 \leqq R100,\ D \leqq \tfrac{2}{3} * R + Q + 5,$$

$$\text{when } 0 \leqq R \leqq 60,\ D \geqq \tfrac{2}{3} * R + Q - 35, \text{ and}$$

$$\text{when } 60 \leqq R \leqq 100,\ D \geqq -\tfrac{2}{3} * R + Q + 45,$$

wherein D represents a temperature (° C.) of the drying step (b) and is more than a dew point, and R and Q represents a humidity (% RH) and a temperature (° C.) of an area where the automatic processor is installed, respectively. The zone is shown in FIG. 1 as the shaded part hereinafter.

It can occur under conditions of relatively high surrounding humidity that light-sensitive materials are not desiccated, or are left as they are in an undried condition. As a result, a situation may occur where dry-processing portion in an automatic processor must be lengthened. However, this is disadvantageous in respect of saving space.

Therefore, the dry-processing portion of an automatic processor is divided into two zones, the front and the rear, and individual temperatures of the drying zones are set independently based on the surrounding temperature and humidity where the automatic processor is installed. The light-sensitive material which has been washed and just squeezed, is dried in the front zone till 65% or less of the moisture present in the material just after squeezing is removed, and in the rear zone the thus pre-dried material is dried at the temperature determined in accordance with the conditions illustrated by the shaded part of FIG. 1 shown hereinafter.

DETAILED DESCRIPTION OF THE INVENTION

The expression "development-processing" as used in this invention includes development, fixation and washing steps. The expression "squeezing" describes a procedure of removing the moisture on the surface of a light-sensitive material using rollers (e.g., made of rubber or resin) or an air squeeze technique consisting of blowing air against the surface following the washing step.

Figure 1:
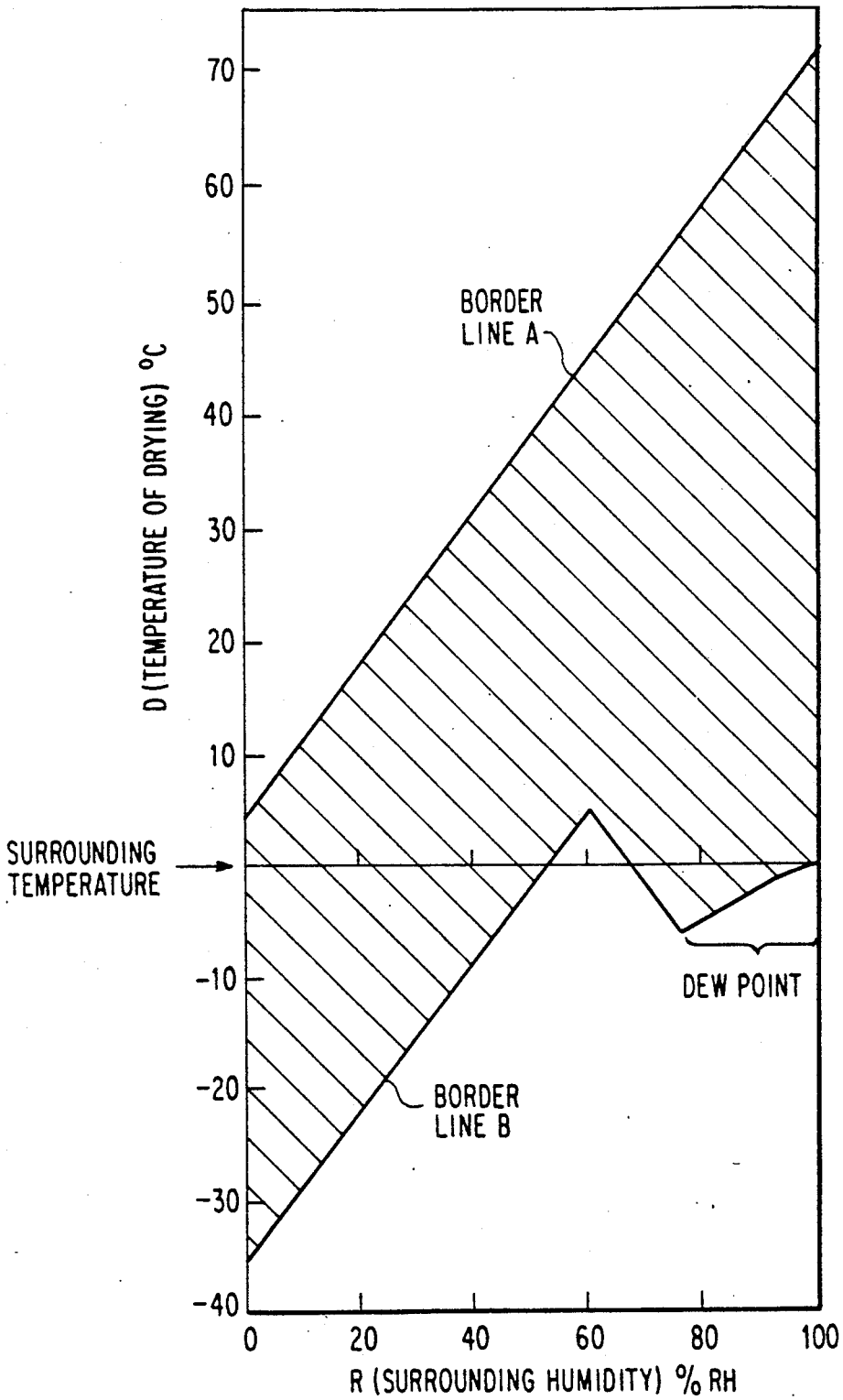
FIG. 1 shows the conditions of the drying temperature in the dry-processing portion of an automatic processor that ensure satisfactory dimensional stability for light-sensitive materials under a wide rang of temperatures and relative humidity. The surrounding humidity (% RH) is the abscissa and drying temperature (° C.) is the ordinate. The shaded part surrounded by the border line a, the border line b and the dew points indicates the area in which satisfactory dimensional stability can be acquired.

When the temperature of drying in an automatic processor is set to a temperature selected according to the surrounding temperature and humidity from the shaded area surrounded by the border lines a and b in FIG. 1, a photographic material having excellent dimensional stability can be realized. According to the present invention, the border line a is defined by the following equation:

$$D=\tfrac{2}{3}*R+Q+5$$

and the border line b obeys the following equation:

$$\text{when } 0\leqq R\leqq 60,\ D=\tfrac{2}{3}*R+Q-35, \text{ and}$$

$$\text{when } 60\leqq R\leqq 100,\ D=-\tfrac{2}{3}*R+Q+45,$$

wherein D represents a temperature (° C.) of the drying step (b) and is more than a dew point, and R and Q represents a humidity (% RH) and a temperature (° C.) of an area where the automatic processor is installed, respectively.

When 60≦R100, since physical properties of hydrophilic colloid binder (e.g., gelatin) in the light-sensitive material change greatly, D decreases with an increase of R, with the proviso that D is more than the dew point.

In one embodiment of the drying method of this invention, the dry-processing portion of an automatic processor is divided into two zones. The temperatures of each zone is controlled independently. The drying in the first zone is set to a temperature higher than room temperature in order that the drying of the light-sensitive material is began rapidly. The second zone is adjusted so that the temperature falls within the shaded area of FIG. 1. As a result, the light-sensitive material becomes free from deficiency in dryness, and acquires excellent dimensional stability.

This invention will now be illustrated in more detail by reference to the following non-limiting examples. Unless otherwise indicated, all ratio and percentages are by weight.

EXAMPLE 1

The dry-processing portion of an automatic processor for lith films, FG-660F, produced by Fuji Photo Film Co., Ltd., was modified to have two drying zones, a front zone and rear zone, in each of which the temperature could be controlled independently. Hereinafter, the front zone is called the first drying zone, and the rear zone is called the second drying zone.

VU-100, produced by Fuji Photo Film Co., Ltd., was used as sample, and processed under various conditions. The variously processed films were examined for dimensional stability using a pin gauge. Two holes measuring 8 mm in diameter were made at an interval of 200 mm in each sample which had been exposed overall prior to development-processing, and the distance between the two holes was measured accurately with the pin gauge with the accuracy of 1/1000 mm precision. This dimension was taken as X (in mm). Each sample was then developed, fixed, washed, and dried, and the distance between the holes determined after the lapse of 5 minutes from the conclusion of the processing as Y (in mm). The processing conditions employed are set forth in Table 1.

TABLE 1

| Processing Step | Processing Solution Used | Temperature | Time |
|---|---|---|---|
| Development | FT-735 ( ) | 38° C. | 20 sec |
| Fixation | GRF-1 ( ) | 38° C. | 20 sec |
| Washing | city water | 25° C. | 20 sec |

( ) products of Fuji Photo Film Co., Ltd.

The rate of dimensional change caused by processing was evaluated in terms of a percentage using the expression, ((Y-X)/200)×100. When film elongates or shrinks by more than 20 μm over 200 mm, this is generally accepted in the industry as a "dimensional deviation". Consequently, excellent dimensional stability involves a rate of dimensional change from −0.01% to +0.01%.

Temperature conditions in the first and second zones are shown in Table 2. The percentage of the moisture removed by drying in the first drying zone was expressed by ((a−b)/(a−c))×100, where the weight of the light-sensitive material just after squeezing with rubber rolls subsequent to the steps with liquids, including development, fixation and washing steps, was taken as "a" (in grams); the weight of the light-sensitive material just after the passage through the first drying zone was taken as "b" (in grams); and the weight of the light-sensitive material which had come to equilibrium with the surrounding temperature and humidity after the processing was taken as "c" (in grams). The flow rate of drying air was set to 40 l/s; this rate was modified for both the first and the second drying zones. The rate of dimensional change was determined under the drying conditions A to L shown in Table 2. Surrounding temperature-humidity condition was adjusted to 25° C-30% RH. The measurement of the rate of dimensional change was carried out under the surrounding temperature-humidity condition. The term "the temperature of drying air" as used herein means are synonymous with the term "the temperature of drying". Results obtained are shown in Table 2. Each of the values for rate of dimensional change (dimensional change rate) shown in Tables is an average of 5 values evaluated by the above-mentioned measurement.

TABLE 2

| Drying Condition | Surrounding temperature and humidity: 25° C., 30% RH Flow rate of drying air: 40 l/s | | | |
|---|---|---|---|---|
| | Drying Air Temperature (°C.) | | Moisture removed | Dimensional |
| | First Zone | Second Zone | in First Zone | Change Rate |
| A | 40 | 30 | 52% | 0.002% |
| B | " | 40 | " | 0.006% |
| C | " | 50 | " | 0.010% |
| D | " | 60 | " | 0.014% |
| E | 50 | 30 | 65% | 0.002% |
| F | " | 40 | " | 0.006% |
| G | " | 50 | " | 0.010% |
| H | " | 60 | " | 0 014% |
| I | 60 | 30 | 75% | 0.014% |
| J | " | 40 | " | 0.016% |
| K | " | 50 | " | 0.018% |
| L | " | 60 | " | 0.020% |

The passing time of the light-sensitive materials is 10 seconds in each of the first zone and the second zone.

In general, a light-sensitive material expands when the drying temperature is raised. As can be seen from Table 2, when the drying temperature of the first drying zone was set to 60° C., the percentage of moisture removed in the first drying zone was more than 65% and the desired dimensional stability was not attained no matter what drying temperature was used in the second drying zone. In contrast, when the drying temperature of the first drying zone was set to 50° C. or lower, the percentage of moisture removed in the first drying zone was 65% or less, and it became feasible to enhance the dimensional stability by setting the temperature of the second drying zone based on the surrounding temperature and humidity.

Thus, desirable dimensional stability is obtainable by setting the drying temperature of the second zone to the surrounding temperature plus 25° C. or lower after 65% of moisture contained in the light-sensitive material has been removed in the first zone.

EXAMPLE 2

Films of VU-100 were used as samples and measure of a light-sensitive material in the same way as in Example 1, except that the surrounding temperature and humidity were set to 25° C. and 60% RH, respectively, and the flow rate of drying air was set to a constant 80 l/s and for both the first and second zones. The results obtained are shown in Table 3.

TABLE 3

| Drying Condition | Surrounding temperature and humidity: 25° C., 60% RH Flow rate of drying air: 80 l/s | | | |
|---|---|---|---|---|
| | Drying Air Temperature (°C.) | | Moisture removed | Dimensional |
| | First Zone | Second Zone | in First Zone | Change Rate |
| A | 40 | 25 | 55% | −0.014% |
| B | " | 30 | " | −0.010% |
| C | " | 40 | " | −0.004% |
| D | " | 50 | " | 0.002% |
| E | 50 | 25 | 60% | −0.014% |
| F | " | 30 | " | −0.010% |
| G | " | 40 | " | −0.004% |
| H | " | 50 | " | 0.002% |
| I | 60 | 25 | 65% | −0.014% |
| J | " | 30 | " | −0.010% |
| K | " | 40 | " | −0.004% |
| L | " | 50 | " | 0.002% |

The passing time of the light-sensitive materials is 10 seconds in each of the first zone and the second zone.

As can be seen from Table 3, the percentage of moisture removed in the first drying zone by the drying under the conditions shown in Table 3 was 65% or less under 25° C. and 60% RH. Thus, when the drying temperature of the first drying zone was set to any temperature, it was possible to improve the dimensional stability by setting the drying temperature of the second drying zone based on the surrounding temperature and humidity. In the case of Example 3, desirable dimensional stability was attained by setting the temperature of the drying air of the second drying zone to the surrounding temperature plus 5° C. or higher.

Figure 2:
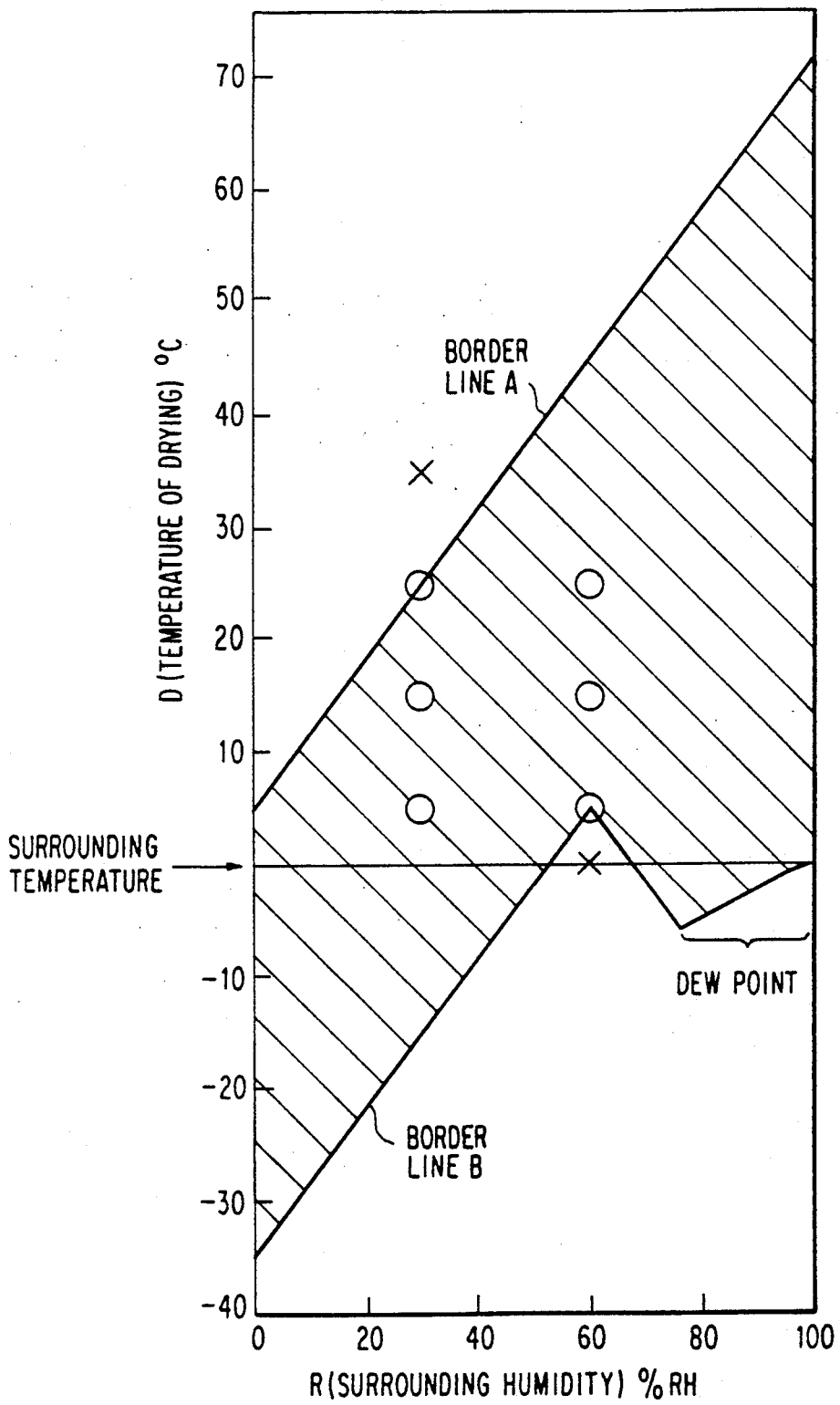
FIG. 2 represents the results of Examples 1 and 2 plotted on the graph of the drying temperature conditions illustrated in FIG. 1. The round marks (O) indicate points of excellent dimensional stability, while the cross marks (x) points those of poor dimensional stability.

In addition, evaluation of dimensional stability in the cases where the percentage of moisture removed in the first drying zone under the conditions attached in Examples 1 and 2 was 65% or less are summarized in FIG. 2. The results obtained are in harmony with the excellent dimensional stability area shown in FIG. 1. Accordingly, it is desirable in order to attain excellent dimensional stability and dry the light-sensitive material under drying conditions that fall in the shaded area of FIG. 1 after the removal of 65% of the moisture.

EXAMPLE 3

Rates of dimensional change under varied conditions were examined in the same manner as in Example 1, that is, under the drying condition that a first drying zone was set at temperature of 50° C. and a second drying zone was set at temperature of 30° C., under which excellent dimensional stability was ensured in Example 1, was adopted, except that flow rates of the drying air were changed as indicated. Similarly to Example 1, the surrounding temperature-humidity condition was 25° C.-30% RH. The results obtained are shown in Table 4.

TABLE 4

| Drying Condition | Surrounding temperature and humidity: 25° C., 30% RH; Drying air temperature in first drying zone: 60° C.; Drying air temperature in second drying zone: 30° C. — Flow Rate of Drying Air ( ) First Zone | Second Zone | Moisture removed in First Zone | Dimensional Change Rate |
|---|---|---|---|---|
| A | 24 | 24 | 65% | 0.002% |
| B | " | 40 | " | 0.002% |
| C | " | 80 | " | 0.002% |
| D | 40 | 24 | 75% | 0.014% |
| E | " | 40 | " | 0.014% |
| F | " | 80 | " | 0.014% |
| G | 80 | 24 | 95% | 0.020% |
| H | " | 40 | " | 0.020% |
| I | " | 80 | " | 0.020% |

( ) l/s unit.
The passing time of the light-sensitive materials is 10 seconds in each of the first zone and the second zone.

Thus, the higher the flow rate of the drying air, the more quickly the light-sensitive material dried. The dimensional stability decreased when a flow rate of the drying air was increased to such an extent that a proportion of the moisture removed by the drying in the first drying zone exceeded 65%. However, dimensional stability remained good as long as the moisture removed in the first drying zone was 65% or less. Thus, it was possible to improve the dimensional stability by adjusting the drying temperature condition based on the surrounding temperature and humidity after the removal of 65% of the moisture.

EXAMPLE 4

LS-2000, produced by Fuju Photo Film Co., Ltd., was employed as light-sensitive material, and examined for a rate of dimensional change in the same manner as in Example 1. Both the emulsion and backing layers of LS-2000 were thicker when dried, and exhibited a greater degree of swelling in water than those of VU-100.

According to the results shown in Table 5, although the percentage of the moisture removable in the first drying zone was less because the degree of swelling was greater, it became was still possible to attain excellent dimensional stability for LS-2000, in analogy with VU-100, by setting a drying temperature of the second drying zone based on the surrounding temperature and humidity as long as the percentage of moisture removed in the first drying zone was 65% or less.

TABLE 5

| Drying Condition | Surrounding temperature and humidity: 25° C., 30% RH; Flow rate of drying air: 80 l/s — Drying Air Temperature (°C.) First Zone | Second Zone | Moisture removed in First Zone | Dimensional Change Rate |
|---|---|---|---|---|
| A | 40 | 30 | 53% | −0.002% |
| B | " | 40 | " | 0.004% |
| C | " | 50 | " | 0.010% |
| D | " | 60 | " | 0.016% |
| E | 50 | 30 | 65% | −0.002% |
| F | " | 40 | " | 0.004% |
| G | " | 50 | " | 0.010% |
| H | " | 60 | " | 0.016% |
| I | 60 | 30 | 73% | 0.016% |
| J | " | 40 | " | 0.020% |
| K | " | 50 | " | 0.024% |
| L | " | 60 | " | 0.028% |

The passing time of the light-sensitive materials is 10 seconds in each of the first zone and the second zone.

EXAMPLE 5

LS-2000 films were used as samples of a light-sensitive material, and examined for dimensional stability under a surrounding temperature-humidity condition of 25° C. and 60% RH in the same manner as in Example 1. Since LS-2000 has a great degree of swelling, it was possible that it would not be completely dried when it emerged from the automatic processor. Therefore, dryness tests were carried out simultaneously with the determination of dimensional change rates. The dryness test was a sensory test involving dryness judged by a finger touch to determine whether the light-sensitive material was completely dried when it emerged from the automatic processor via the dry-processing portion.

The results obtained are shown in Table 6. In this example also, it was also possible to ensure excellent dimensional stability of the light-sensitive material by setting the drying temperature of the second drying zone based on the surrounding temperature-humidity condition and the percentage of the moisture removed in the first drying zone was 65% or less. However, if the proportion of the moisture removed in the first drying zone were less than 40%, the processed samples were in a poorly dried. Consequently, it is most desirable that the first drying zone be set to a temperature at which the largest possible proportion of the moisture is removed, provided that said proportion does not exceed 65%. That is, preferably, 40% to 65% of a moisture content of the photographic light-sensitive material just after squeezing is dried out in the first zone and the remainder of the moisture content of the photographic light-sensitive material is dried out in the second zone.

TABLE 6

| Drying Condition | Surrounding temperature and humidity: 25° C., 60% RH Flow rate of drying air: 80 l/s — Drying Air Temperature (°C.) First Zone | Second Zone | Moisture removed in First Zone | Dimensional Change Rate | Dried State |
|---|---|---|---|---|---|
| A | 40 | 25 | 28% | −0.015% | poor |
| B | " | 30 | " | −0.010% | " |
| C | " | 40 | " | −0.008% | " |
| D | " | 50 | " | −0.008% | " |
| E | 50 | 25 | 40% | −0.015% | good |
| F | " | 30 | " | −0.010% | " |
| G | " | 40 | " | −0.002% | " |
| H | " | 50 | " | 0.004% | " |
| I | 60 | 25 | 65% | −0.015% | " |
| J | " | 30 | " | −0.010% | " |
| K | " | 40 | " | −0.002% | " |
| L | " | 50 | " | 0.004% | " |

The passing time of the light-sensitive materials is 10 seconds in each of the first zone and the second zone.

EXAMPLE 6

An automatic processor modified to have a first drying zone wherein a photographic light-sensitive material is dried with infrared heaters in which the temperature is set based on temperature and humidity conditions in an area where the automatic processor is installed and a second drying zone wherein the photographic light-sensitive material is dried out with drying air having the temperature set based on temperature and humidity conditions in an area where the automatic processor is installed was used. The rate of dimensional change of Samples 1 to 16 as shown in Table 7 was measured in the same manner as in Example 1. The conditions of surrounding and drying are shown in Table 8. The results were that the rate of dimensional change of each of Samples 1 to 16 was from 0.002 to 0.006%. It can be apparently seen that the use of the method of drying of the present invention results in the improvement of the rate of dimensional change and good performance of the photographic light-sensitive material.

TABLE 7

| Sample No. | Light-sensitive material* type | maker*** | Processing condition** developing | | fixing | | washing | |
|---|---|---|---|---|---|---|---|---|
| 1 | VU-100 | FUJI | GR-D1 | 38° C. 20 sec | GR-F1 | 38° C. 20 sec | tap water | 25° C. 20 sec |
| 2 | VU-S100 | " | " | " | " | " | " | " |
| 3 | KUV-100 | " | LD-835 | " | LF-308 | " | " | " |
| 4 | DU-H100 | " | " | " | " | " | " | " |
| 5 | DU-100 | " | " | " | " | " | " | " |
| 6 | QCF | KODAK | " | " | " | " | " | " |
| 7 | QDF | " | " | " | " | " | " | " |
| 8 | HCF | " | " | " | " | " | " | " |
| 9 | HDF | " | " | " | " | " | " | " |
| 10 | DL-511P | DUPONT | " | " | " | " | " | " |
| 11 | DLD-510P | " | " | " | " | " | " | " |
| 12 | BLX-II | AGFA | " | " | " | " | " | " |
| 13 | BLC-III | " | " | " | " | " | " | " |
| 14 | BLD | " | " | " | " | " | " | " |
| 15 | CRH-100E | KONIKA | CDM-651K | 28° C. 30 sec | CFL-851 | 28° C. 30 sec | tap water | 25° C. 30 sec |
| 16 | CRHD-100E | " | " | " | " | " | " | " |

*All light-sensitive materials were used after an incubation at 25° C. 60% RH for 1 week.

**GR-D1, GR-F1, LD-835, and LF-308; products of Fuji Photo Film Co., Ltd. CDM-651K and CFL-851; products of Konika Corporation

***FUJI; Fuji Photo Film Co., Ltd.

KODAK; Eastman Kodak Company

DUPONT; E. I. Du Pont de Nemours & Co.

KONICA; Konica Corporation

AGFA; AGFA-Gevaert, N.V.

TABLE 8

| Surrounding temperature and humidity | Drying Condition | | |
|---|---|---|---|
| | Capacity of infrared in the first drying zone (W) | Temperature of drying air in the second drying zone (°C.) | Flow rate of drying air in the first zone the second zone (l/s) |
| 25° C. 30% RH | 670 | 30 | 40 |
| 25° C. 60% RH | 770 | 50 | 40 |

What is claimed is:

1. A method of drying a photographic light-sensitive material after development-processing in an automatic processor comprising a dry-processing portion, wherein said method comprises drying steps (a) and (b):

(a) drying said photographic light-sensitive material to an extent that 65% of the moisture content of said photographic material just after squeezing is dried out; and subsequently, (b) drying said photographic light-sensitive material at a temperature which is set based on temperature and humidity conditions of an area where said automatic processor is installed.

2. The method of drying a photographic light-sensitive material as claimed in claim 1, wherein said temperature of said drying step (b) falls within the zone which satisfies the following equations:

when $0 \leqq R \leqq 100$, $D \leqq \frac{2}{3} * R + Q + 5$, when $0 \leqq R \leqq 60$, $D \geqq \frac{2}{3} * R + Q - 35$, and when $60 \leqq R \leqq 100$, $D \geqq -\frac{2}{3} * R + Q + 45$, wherein D represents a temperature (° C.) of said drying step (b) and is more than a dew point, and R and Q represents a humidity (% RH) and a temperature (° C.) of an area where said automatic processor is installed, respectively.

3. A method of drying a photographic light-sensitive material in an automatic processor as claimed in claim 1, wherein said dry-processing portion of said automatic processor is divided into a first zone and a second zone, each temperature of said zones is set independently based on temperature and humidity conditions of an area where said automatic processor is installed, and said method comprises:

(a) drying said photographic light-sensitive material in said first zone to an extent that 65 % or less of a moisture content of said photographic light-sensitive material just after squeezing is dried out; and subsequently (b) drying said photographic light-sensitive material in said second zone at a temperature that falls within the zone which satisfies the following equations:

when $0 \leqq R' \leqq 100$, $D' \leqq \frac{2}{3} * R' + Q' + 5$, when $0 \leqq R' \leqq 60$, $D' \geqq \frac{2}{3} * R' + Q' - 35$, and when $60 \leqq R' \leqq 100$, $D' \geqq -\frac{2}{3} * R' + Q' + 45$, wherein D' represents a temperature (° C.) of said second zone and is more than a dew point, and R, and Q, represents a humidity (% RH) and a temperature (° C.) of an area where said automatic processor is installed, respectively.

4. A method of drying a photographic light-sensitive material in an automatic processor as claimed in claim 3, wherein 40% to 65% of a moisture content of the photographic light-sensitive material just after squeezing is dried out in said first zone and the remainder of the moisture content of the photographic light-sensitive material is dried out in said second zone.

* * * * *